US006857213B2

(12) United States Patent
Fluhr

(10) Patent No.: US 6,857,213 B2
(45) Date of Patent: Feb. 22, 2005

(54) LOADING INDICATORS FOR FIREARMS

(75) Inventor: Norbert Fluhr, Oberndorf (DE)

(73) Assignee: Heckler & Koch GmbH, Oberndoft/Neckar (DE)

( * ) Notice: Subject to any disclaimer, the term of this patent is extended or adjusted under 35 U.S.C. 154(b) by 0 days.

(21) Appl. No.: 10/726,914

(22) Filed: Dec. 3, 2003

(65) Prior Publication Data

US 2005/0016048 A1 Jan. 27, 2005

Related U.S. Application Data

(63) Continuation of application No. PCT/EP02/13389, filed on Nov. 17, 2002.

(30) Foreign Application Priority Data

Nov. 28, 2001 (DE) ..... 101 58 323

(51) Int. Cl.[7] ..... F41A 9/53
(52) U.S. Cl. ..... 42/1.05
(58) Field of Search ..... 42/1.01, 1.05

(56) References Cited

U.S. PATENT DOCUMENTS

| | | | | | |
|---|---|---|---|---|---|
| 790,634 | A | * | 5/1905 | Hirsh | 42/136 |
| 808,463 | A | * | 12/1905 | Luger | 42/16 |
| 1,028,032 | A | * | 5/1912 | Krag | 89/140 |
| 1,896,820 | A | | 1/1933 | Jolidon | 89/148 |
| 1,992,934 | A | * | 3/1935 | Bamberger | 42/1.05 |
| 2,100,273 | A | * | 11/1937 | Skandera | 42/1.05 |
| 4,100,691 | A | * | 7/1978 | Wicklund | 42/1.05 |
| 4,142,443 | A | | 3/1979 | Bourlet | 89/33.01 |
| 6,256,915 | B1 | * | 7/2001 | da Silveira | 42/1.05 |

FOREIGN PATENT DOCUMENTS

| | | | | |
|---|---|---|---|---|
| DE | 32775 | | 3/1885 | |
| DE | 164853 | | 5/1904 | |
| DE | 334041 | | 8/1919 | |
| DE | 0334041 | * | 3/1921 | 42/1.05 |
| DE | 361248 | | 10/1922 | |
| GB | 0001290 | * | 1/1886 | 42/1.05 |

OTHER PUBLICATIONS

International Search Report for International Patent Application PCT/EP 02/13389, Feb. 12, 2003, 4 pages.

* cited by examiner

*Primary Examiner*—Stephen M. Johnson
(74) *Attorney, Agent, or Firm*—Hanley, Flight & Zimmerman, LLC

(57) ABSTRACT

A loading indicator for use in a firearm having a barrel including a rear section and a cartridge chamber is disclosed. In one example, the loading indicator includes an elastic shaft disposed within a compartment in the rear section of the barrel and a feeler portion coupled to the elastic shaft, wherein the elastic shaft is loaded to cause the feeler portion to project into the cartridge chamber and wherein the loading of the elastic shaft allows the feeler portion to be displaced when a cartridge is placed into the cartridge chamber. The example implementation further includes an indicator element adjacent the feeler portion and coupled to the elastic shaft, wherein the indicator element projects from the cartridge chamber when the feeler portion is displaced by a cartridge.

15 Claims, 3 Drawing Sheets

LOADING INDICATORS FOR FIREARMS

CROSS-REFERENCE TO RELATED APPLICATIONS

This case is a continuation of International Patent Application PCT/EP02/13389, filed Nov. 17, 2002, which claims the benefit of German Patent Application 101 58 323.0, filed Nov. 28, 2001.

TECHNICAL FIELD

This disclosure relates to firearms and, more particularly, to loading indicators for firearms.

BACKGROUND

In all of the following instances, terms describing relative positions such a s, for example, "front" and "above," are premised on the assumption that the described firearm is ready to fire in the usual shooting position wherein the muzzle is in "front" and the sighting device is "above".

In the $19^{th}$ century it was known to drill into firearm cartridge chamber as was done for the Beaulieu rifle, Model 1854, used by the bodyguards of the French king. In this rifle, a finger spring, which extends into the cartridge chamber from above, holds the cartridge chamber fixed when the breech is open and prevents the cartridge from sliding out. Only 200 men were equipped with this weapon and it is not known whether this cartridge finger spring mounting proved worthwhile. This rifle was designed for Lefaucheux cartridges, which were also called pinfire cartridges.

Such a cartridge mounting mechanism is also used in the weapon that forms the generic concept, (i.e. the rifle disclosed in German patent DE 32 775). In this type of mounting arrangement, however, the cartridge holder is constructed as a pivoting lever and extends to the top. The extending lever projects out of the cartridge chamber and forms an indicator element that can be seen or felt on the upper side of the weapon.

German patent DE 32 775, published in 1885, assumes a black powder shot gun. The German patent refers exclusively to Lefaucheux cartridges (i.e., pinfire cartridges), which are loaded exclusively with black powder and, at that time, were known only for shot guns and small arms. In particular, the shot gun cartridges had a gas pressure that was very small in comparison to the gas pressure of modern pistol cartridges.

Similar loading indicators are known from 1921 (DE 334 041) and 1934 (U.S. Pat. No. , 1,992,934). The German prior art document proposes laying the cartridge feeler in the collar area of a rifle cartridge. The design disclosed in the German patent may result in jamming, a situation in which the closed cartridge case can no longer be removed from the chamber, assuming the weapon does not fail during shooting. The US prior art document shows a small caliber rifle having a quite small gas pressure. In it, the weapon may indeed function properly during weapon firing, but removal of cartridges will likely prove problematic due to the loading indicator.

As early as the 1900, extractors were used as loading indicators in the Parabellum pistols, which were built in Germany as ordinance until 1942. This loading indicator was mounted on the top and was clearly visible to the side. The assignee of the present patent, until now, used a similar loading indicator to the Parabellum pistol. Drawbacks to this loading indicator include the fact that the loading indicator protrudes only slightly from the weapon and such a protrusion is on the side of the weapon.

Other loading indicators are also known, such as the loading indicator of the Walther PP, PPK, and P38 pistols. However, these loading indicator arrangements require a drilled hole through the slide ending in the breechblock, the use of a long structural part, and a separate, dedicated spring. This loading indicator can either only be practically observed when the pistol is in hand, as with the Walther pistols, or the loading indicator prevents the drawing of the weapon, as in the Sauer and Sohn model 1938 pistol.

DETAILED DESCRIPTION

The following description and drawings refer to a loading indicator as being a spring wire. However, those having ordinary skill in the art will readily recognize that substitutions may be made. For example, while the term spring wire is used herein, those having ordinary skill in the art will recognize that spring wire may be an elastic metal wire, but may also be a correspondingly formed leaf spring, a flat-rolled spring wire, or even a plastic part, all of which are inexpensive to manufacture. Additionally, while the drawings show a pistol barrel 2, which is planned to be accommodated in a automatic pistol of the modified Colt-Browning system, those having ordinary skill in the art will readily recognize that such an implementation is merely an example and that the disclosed loading indicator can be used in any number of different firearms and/or firearm systems.

A loading indicator for an automatic pistol or a recoiling submachine gun is disclosed herein. As used herein, recoiling submachine gun is understood to mean a submachine gun that has a breech that is closed when the weapon is ready to fire as in a rapid-fire gun, and not open as is customary most often for a submachine gun. Modern ordinance pistol cartridges, which have a smaller gas pressure than rifle cartridges, are fired.

Figure 1:
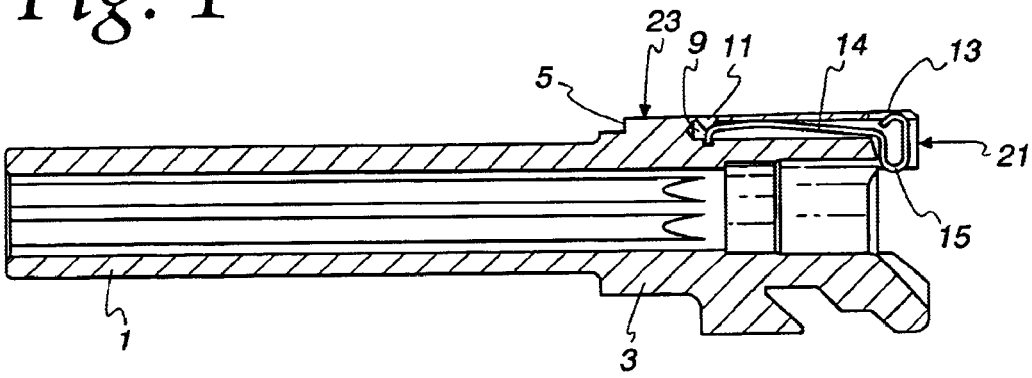
FIG. 1 is an illustration of an unloaded pistol barrel, in longitudinal section.

Referring to FIG. 1, the barrel 2 has a cylindrical, long front section 4, and a short rear section 6. On its underside, the barrel includes formations and guide curves 8, for its attachment and guidance in the pistol. The upper side of the barrel 2 includes a locking projection 10, which rests with a facing surface or collar surface 12 against a breech (not shown) of the weapon, and, to be precise, against the front edge of the ejector window of the lock and/or slide as described in detail hereinafter, a loading indicator 14 is inserted in the rear section 6 of the barrel 2.

A cartridge chamber 16 is located in the inside of the rear section 6 of the barrel 2. The cartridge chamber 16 and the rear section 6 are the parts of the barrel 2 that experience the highest gas pressure upon firing of the firearm and, therefore, the barrel wall is thickest in this region.

Figure 2:
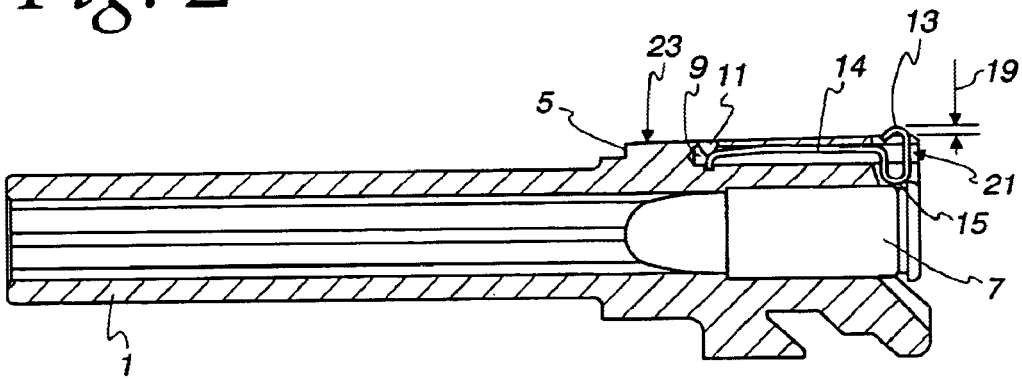
FIG. 2 is an illustration of the pistol barrel of FIG. 1, but is shown loaded.

As can be seen from the comparison of FIGS. 1 and 2, the cartridge chamber 16 is shorter than a cartridge 18 (FIG. 2). The rear section of the cartridge chamber 16 and the breechblock are located in the breech. When the cartridge 18 is inserted in the cartridge chamber 16, the neck of an extractor is located by the bottom of the cartridge chamber 16. However, all zones of the cartridge 18, in which a notable pressure enters during firing, lie within the barrel portion of the cartridge chamber 16.

A rear upper side of the barrel 2 includes an extension that extends beyond the zones mentioned and further includes a substantially centered cut 20, which may be milled. The cut 20 lies in the vertical center plane of the barrel 2, which also contains the axis of the barrel bore (i.e. the middle axis). The cut 20 extends from the upper side of the locking projection 10 to the bottom into the cartridge chamber 16. The cut 20 does not extend, however, into the area that supports the cartridge 18, due to pressure safety considerations during firing. The cut 20 is located in a place in which no bulging of a cartridge case can occur due to firing pressure, even for pressures associated with modern high-performance pistol cartridges. In fact, the cut 20 is hardly larger from conventional milled cuts customarily made in the cartridge chamber 16 to accommodate an ejector. Accordingly, the edge of the notch ends as early as, for example, the height of the inner case bottom, where in addition, the wall thickness of the case reaches a maximum.

A drill hole 22 extends through the cut 20 and has a diameter that exceeds the width of the cut 20. The drill hole 22 extends to the front, parallel to the axis of the bore, until approximately the point where the grooves and fields of the barrel 2 begin. The drill hole 22 has a length that corresponds approximately to that of the cartridge chamber 16. For the ease of understanding and readability, the grooves and fields of the barrel 2 are shown as straight lines, but actually run with at an angle in the circumferential direction as is customary. The drill hole 22 does not influence the strength of the barrel 2 in the area of the cartridge chamber 16 because the wall thickness in this region is already substantial due to the aforementioned locking projection 10. The drill hole 22 could be constructed as a groove to make possible a sufficient spring path for the spring shaft.

At the end of the drill hole 22, approximately at the height of the front end of the cartridge chamber 16, a transverse drill hole 24 extends from outside and from above the barrel 2 through the drill hole 22 and runs out on the side of the drill hole 22 that faces the cartridge chamber 16. Alternatively, the transverse drill hole 24 could be made by electrical discharge machining, as opposed to drilling. If the barrel 2 has already been clamped for the milling of the chamber, the drill hole 22 and the transverse drill hole 24 can also be made without a special clamping being necessary.

The transverse drill hole 24, whether it be created by drilling or some other method, is especially inexpensive and has numerous advantages. For example, the transverse drill hole 24 provides a grasping opportunity so that the end of the shaft of the loading indicator 14 can be grasped through the transverse drill hole 24, and lifted so that the entire loading indicator 14 can be removed from the and drill hole 22 from the rear. Thus, if it should ever be necessary, a simple disassembly of the loading indicator 14 is possible. Additionally, should water get into the weapon, it can simply be removed again from the drill hole, whereby weapon oil is dripped into the vertically held drill hole 22 all around the loading indicator 14, and the oil then runs to the bottom along the drill hole 22 and comes out at the transverse drill hole 24. Closed air bubbles, in which moisture could be held, cannot form since the lower, but front end of the drill hole 22 in the position defined at the beginning, is indeed open to the outside.

A loading indicator 14 is installed within the drill hole 22 and is a combination of an indicator element 30, a feeler 32, and a shaft 34. The loading indicator 14 and it's associated portions 30, 32, 34 are reminiscent of a bent ratchet made from spring wire. The feeler 32 and the indicator element 30 form lower and upper parts of the whole flat hand grip, the shaft 34 forms the shaft of the ratchet, but is slightly bent to the top, and the hook is formed from a bend on the free end of the shaft 34. Advantageously, at least the part of the spring wire that forms the loading indicator 14 is colored in a color that contrasts with the outer surface of the cartridge chamber 16. The spring wire namely forms a strap, whose outer surface runs, when the pistol is unloaded, flush with the adjacent outer surface of the barrel on the cartridge chamber. The spring wire can then be ground down on this outer surface and be polished or gunmetal finished, phosphatized or bonderized, so that the outer surface does not rise from the adjacent surface. Additionally, the wire strap can also be filled with paint or a plastic. Red paint, for example, would be especially easy to recognize as an indicator.

During installation, the loading indicator 14 is inserted into the drill hole 22, against which the shaft 34 is then braced, as a result of its bend, slightly to the top, until the bend falls to the bottom into the outlet of the transverse drill hole 24. In one example, the diameter of the drill hole 22 is larger than that of the shaft 34, and the shaft 34 is easily bent away from the cartridge chamber 16 to fund a mount by being clamped in the drill hole 22, and to have a sufficient spring path. The bent shaft is braced in the drill hole 22 and simultaneously provides for a bearing point so that the elastic part of the shaft 34 always stays the same. After the loading indicator 14 is installed, the indicator element 30 and the feeler 32 sit in the cut 20. When the weapon is unloaded, the shaft 34 is in its resting position and the feeler 32 dives to the bottom into the cartridge chamber 16 so that the indicator element 30 disappears far enough into the cut 20 so that it cannot be seen from the side. This condition is shown in FIG. 1.

When the cartridge 18 is inserted into the cartridge chamber 16 (FIG. 2), it, pushes or displaces the feeler 32 to the outside, or upwards. A significant advantage to the disclosed arrangement is that the spring force can be kept very small in comparison to an indicator via the extractor and thus does not act in a disruptive manner during the feeding of cartridges. In this way, the indicator element 30 is likewise pushed or displaced to the outside by such a distance 38 that it can be clearly seen from both sides above the surface of the locking projection 10. For example, an indication that the firearm is loaded can be seen when the weapon lies on a table and it can only be seen from one side. Additionally, the indicator element 30 can be easily seen when a marksman takes aim because the indicator element 30 is located directly beneath the sighting line. Further, a teacher or instructor standing next to the marksman, will readily recognize whether the weapon is loaded or not, and can intervene if necessary, before an incident occurs.

The distance 38 is at least the value that results from the diameter of the drill hole 9 less the thickness of the shaft 34. By milling on the outer side of the drill hole 22 as a continuation of the cut 20 to the front, however, this value can be considerably increased.

Figure 3:
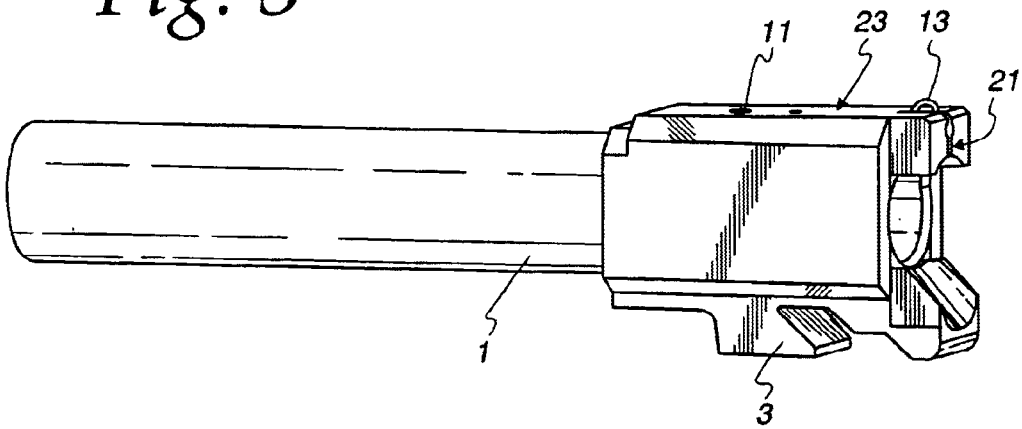
FIG. 3 is an illustration of the pistol barrel of FIGS. 1 and 2, seen obliquely from behind.

The pistol barrel 2 is shown in the view in FIG. 3. In this drawing, the indicator element 30 shows the presence of a cartridge 18 in the cartridge chamber. The cartridge 18 (FIG. 2) was omitted, however, for the sake of clarity and comparison in FIG. 3.

Figure 4:
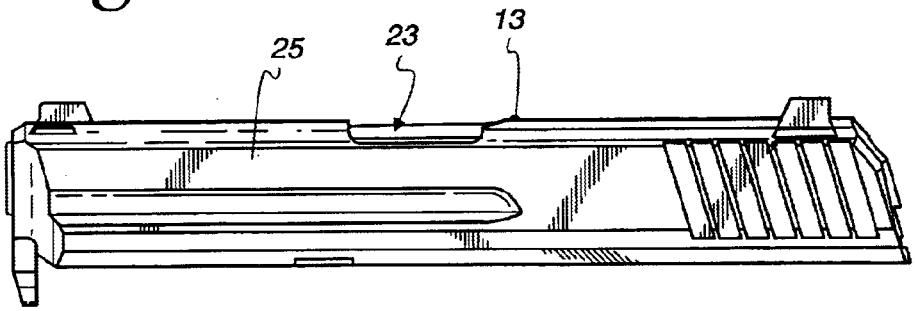
FIG. 4 is an illustration of a side view of a pistol slide including a mounted barrel, wherein a cartridge is located in the cartridge chamber (i.e., the weapon is loaded).
Figure 5:
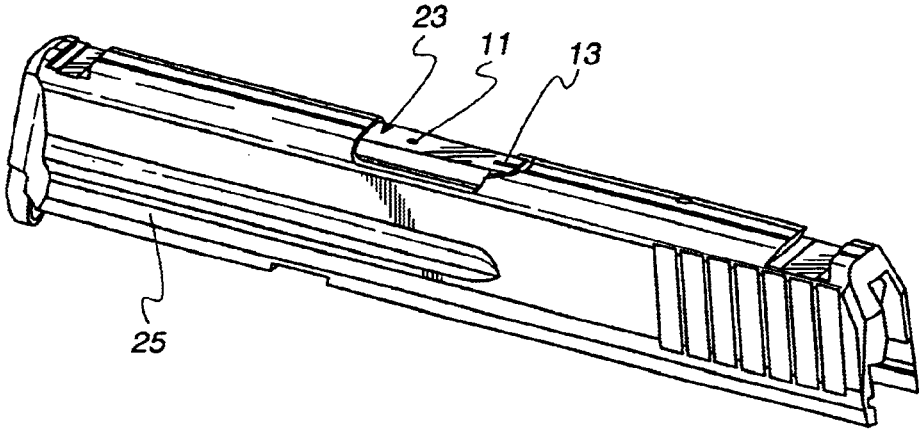
FIG. 5 is an illustration of the slide of FIG. 4, seen obliquely from behind, wherein the weapon is unloaded.
Figure 6:
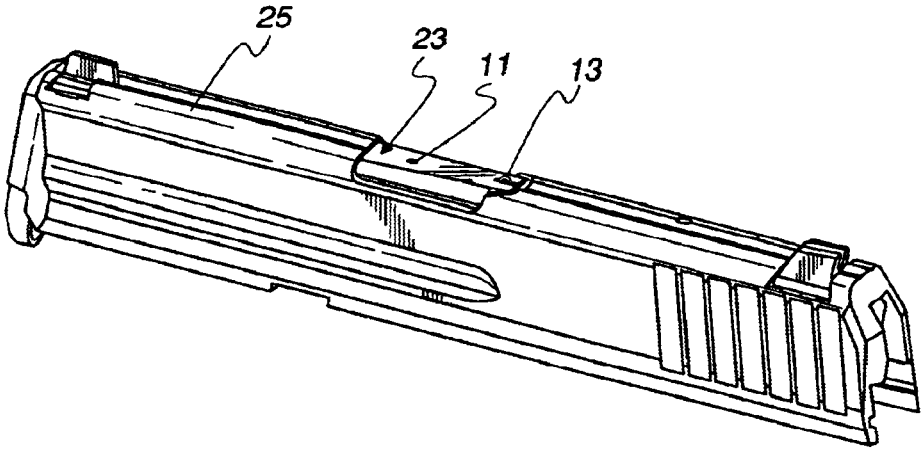
FIG. 6 is an illustration of the slide of FIG. 4, see obliquely from behind, wherein the weapon is loaded.

As shown in FIGS. 4–6, the pistol barrel 2 may be combined with a slide 40. The slide 40 includes a window 42 through which the indicator element 30 is visible. During firing of the weapon, the slide 40 travels rearwardly and the spend shell casing is ejected through the window 42 before the slide 40 returns to its position as shown in FIGS. 4–6. In FIGS. 4 and 6, the pistol barrel 2 is loaded and, therefore, the indicator element 30 is visible in the window 42 of the slide. Conversely, in FIG. 5, the pistol barrel is unloaded and the indicator element 30 is, therefore, not visible in the window 42.

Although certain apparatus constructed in accordance with the teachings of the invention have been described herein, the scope of coverage of this patent is not limited thereto. On the contrary, this patent covers every apparatus, method and article of manufacture fairly falling within the scope of the appended claims either literally or under the doctrine of equivalents.

What is claimed is:

1. A loading indicator for use in a firearm having a barrel including a rear section and a cartridge chamber, the loading indicator comprising:

an elastic shaft disposed within a compartment in the rear section of the barrel, wherein the compartment in the rear section of the barrel comprises a diameter larger than that of the shaft, and the shaft is bendable from the cartridge chamber to find a mount by being clamped in the compartment;

a feeler portion coupled to the elastic shaft, wherein the elastic shaft is loaded to cause the feeler portion to project into the cartridge chamber and wherein the loading of the elastic shaft allows the feeler portion to be displaced when a cartridge is placed into the cartridge chamber; and an indicator element adjacent the feeler portion and coupled to the elastic shaft, wherein the indicator element projects from the cartridge chamber when the feeler portion is displaced by the cartridge, wherein the feeler portion and the indicator element are coupled to a first end of the shaft and wherein the second end of the shaft comprises a bent end and wherein the compartment includes a recess into which the bent end is placed.

2. A loading indicator according to claim 1, wherein the recess is formed by a transverse drill hole that is made through an outer wall of the barrel and into the compartment.

3. A loading indicator as defined by claim 1, wherein the indicator element comprises one of a spring wire, a leaf spring and a plastic part and wherein at least part indicator element is colored with a color that contrasts with an outer surface of the cartridge chamber.

4. A loading indicator for use in a firearm having a barrel including a rear section and a cartridge chamber, the loading indicator comprising:

an elastic shaft disposed within a compartment in the rear section of the barrel, wherein the compartment is located in a thickened section of the barrel and the cartridge chamber that, in automatic pistols that are ready to fire, goes through an ejector window forms a locking projection;

a feeler portion coupled to the elastic shaft, wherein the elastic shaft is loaded to cause the feeler portion to project into the cartridge chamber and wherein the loading of the elastic shaft allows the feeler portion to be displaced when a cartridge is placed into the cartridge chamber; and an indicator element adjacent the feeler portion and coupled to the elastic shaft, wherein the indicator element projects from the cartridge chamber when the feeler portion is displaced by the cartridge.

5. A loading indicator for use in a firearm including a barrel and a cartridge chamber having a notch in the outermost rear portion of the cartridge chamber, the loading indicator comprising:

a feeler projecting into the cartridge chamber;

an indicator element projecting to the outside from a loaded cartridge chamber;

wherein the feeler and the indicator element are constructed as a single part that sits in the notch in the cartridge chamber and that is loaded so that the feeler is elastic to the inside of the cartridge chamber, wherein the single part is constructed as a single-piece wire strap comprising one of spring wire and a plastic part that sits on the cartridge chamber, and wherein the single part includes an elastic shaft that sits in a longitudinal drill hole that is constructed parallel to the cartridge chamber and adjacent the cartridge chamber in a structural part that forms the barrel.

6. A loading indicator as defined by claim 5, characterized in that a diameter of the longitudinal drill hole is larger than the diameter of the elastic shaft, and the elastic shaft is easily bent away from the cartridge chamber, in order to find a mount by being clamped in the longitudinal drill hole, and to have a sufficient spring path.

7. A loading indicator as defined by claim 6, wherein the longitudinal drill hole comprises a recess that a bent end of the elastic shaft grasps.

8. A loading indicator as defined by claim 7, comprising a transverse drill hole in an outer wall of the cartridge chamber and that passes through the longitudinal drill hole and forms the recess at its end.

9. A loading indicator as defined by claim 5, wherein at least a part of the single-piece wire strap comprises a color that contrasts with an outer surface of the cartridge chamber.

10. A loading indicator as defined by claim 5, wherein the longitudinal drill hole is located in a thickened section of the barrel and the cartridge chamber that forms a locking projection in an automatic firearm.

11. A barrel for a firearm, the barrel comprising:

a locking projection including a longitudinal drill hole;

a cartridge chamber adjacent the locking projection, wherein the cartridge chamber comprises a notch on an outermost portion of the cartridge chamber; and a unitary loading indicator located in the longitudinal drill hole and the notch, wherein the unitary loading indicator includes a feeler projecting into the cartridge chamber, an indicator element projecting from the cartridge chamber when a cartridge is inserted therein, and wherein the unitary loading indicator is elastic, wherein a diameter of the longitudinal drill hole is larger than a diameter of the unitary loading indicator and includes a recess into which a bent end of the unitary loading indicator extends, and wherein the unitary loading indicator is easily bent away from the cartridge chamber to find a mount by being clamped in the longitudinal drill hole while still having a spring path.

12. A barrel for a firearm as defined by claim 11, wherein the unitary loading indicator comprises a single-piece wire strap.

13. A barrel for a firearm as defined by claim 12, wherein the unitary loading indicator comprises one of spring wire, a leaf spring, and a plastic part.

14. A barrel for a firearm as defined by claim 11, wherein the recess is formed by a transverse drill hole in an outer wall of the cartridge chamber that extends into and through the longitudinal drill hole.

15. A barrel for a firearm as defined by claim 11, wherein at least a portion of the unitary loading indicator is colored to contrast with an outer surface of the cartridge chamber.

* * * * *